US007722101B2

(12) United States Patent
Bellehumeur et al.

(10) Patent No.: US 7,722,101 B2
(45) Date of Patent: May 25, 2010

(54) CARGO SHIPPING CONTAINER SPREADER AND METHOD

(75) Inventors: Alexander R. Bellehumeur, Long Beach, CA (US); James Woods, Tustin, CA (US); John Wells, Long Beach, CA (US)

(73) Assignee: Alex R. Bellehumeur, Trustee of the Alex Bellehumeur Family Trust, Long Beach, CA (US)

( * ) Notice: Subject to any disclaimer, the term of this patent is extended or adjusted under 35 U.S.C. 154(b) by 235 days.

(21) Appl. No.: 11/879,412

(22) Filed: Jul. 17, 2007

(65) Prior Publication Data

US 2008/0011742 A1 Jan. 17, 2008

Related U.S. Application Data

(60) Provisional application No. 60/831,384, filed on Jul. 17, 2006.

(51) Int. Cl.
*B66C 1/66* (2006.01)
*B65D 88/52* (2006.01)

(52) U.S. Cl. ..... 294/81.53; 294/81.51; 220/1.5; 220/6

(58) Field of Classification Search ..... 294/81.53, 294/81.51, 81.1, 81.4, 81.41, 81.61, 2; 220/1.5, 220/6, 7

See application file for complete search history.

(56) References Cited

U.S. PATENT DOCUMENTS

| | | | |
|---|---|---|---|
| 3,568,608 | A | 3/1971 | Taylor |
| 3,606,053 | A | 9/1971 | Whiteman |
| 4,214,669 | A | 7/1980 | McQuiston |
| 4,577,772 | A | 3/1986 | Bigliardi |
| 4,795,203 | A | 1/1989 | Karlsson |
| 4,848,618 | A | 7/1989 | Yuan et al. |
| 6,068,324 | A | 5/2000 | DeKlotz |

FOREIGN PATENT DOCUMENTS

| | | | |
|---|---|---|---|
| GB | 539390 | A | 9/1941 |

OTHER PUBLICATIONS

International Search Report issued May 16, 2008, pp. 1-3.

*Primary Examiner*—Dean J Kramer
(74) *Attorney, Agent, or Firm*—Fulwider Patton LLP

(57) ABSTRACT

An apparatus and method for lifting and collapsing a collapsible cargo container includes a frame, and vertical guides for aligning the spreader with the cargo container. First and second pusher assemblies engage the end walls of the container to pivot the end walls against the ceiling of the container, where uplocks retain the end walls in a stowed away position. Foldable side walls are then buckled by the weight of the ceiling with assistance from the spreader, until the side walls occupy a predominantly horizontal position between the ceiling/end wall combination and a floor of the cargo container, resulting in a compact configuration. The spreader unfolds the container using steps discussed above in a reverse order.

5 Claims, 10 Drawing Sheets

CARGO SHIPPING CONTAINER SPREADER AND METHOD

CROSS REFERENCE TO RELATED APPLICATION

This patent application claims priority from U.S. Provisional Patent Application No. 60/831,384, filed Jul. 17, 2006, and U.S. patent application Ser. No. 11/792,161, filed Jun. 1, 2007, the contents of each of which are fully incorporated herein by reference.

BACKGROUND OF THE INVENTION

The shipping industry employs the use of large cargo containers to transport cargo shipped from one location to another. These containers can be easily and conveniently loaded and unloaded, and moved from one transport vehicle or vessel to another for transport across land and/or sea. In this manner, goods traveling to a common destination can be easily moved in large quantities to reduce the amount of time required for loading and unloading the transport vessels.

The cargo containers in use today have largely become standardized in dimension and structural, and are such that they can be easily, conveniently and securely stacked vertically in a side by side and end to end relationship to maximize the use of hold and deck space on ships and the like, on which such containers are placed.

The principal shortcoming found in the use of cargo containers of the character referred to above resides in the fact that day to day commerce can require that these containers be transported empty from a station or site of delivery of cargo to a next site or station for loading of cargo. Such transporting of empty containers is non-profitable since each such container occupies valuable and costly space that could otherwise accommodate a loaded or filled container. Further, the handling and shipping of both loaded and empty containers creates a multitude of other problems. One such problem resides in arranging light, empty containers and heavy, loaded containers aboard ships in such a manner that the ships are properly and safely trimmed.

When transporting a high percentage of empty containers, the voyage of such ships is uneconomical and the inefficiencies must be made up elsewhere with increased costs of goods. In view of the foregoing, large economic savings could be realized if empty containers could be folded or collapsed so that they occupy a fraction of the space they occupy when in their normal configuration. If two containers, when collapsed, could occupy the space of one container in its normal configuration, the cost of shipping empty collapsed containers would be reduced significantly.

As with conventional cargo containers, collapsible cargo containers require an apparatus called a "spreader" to lift the cargo containers from loading platforms to ships, trains, and the like, and from ships, trains, etc. to the loading platforms. These spreaders are large crane structures with interlocking mechanisms to grip or engage the cargo containers for lifting from one location to another, and to prevent them from tilting or dropping during the transfer operation. Spreaders are typically utilized at shipping ports, train stations, etc. where large numbers of containers are handled on a daily basis. Some are designed to lift containers of a specific length, while others are adjustable to accommodate various sized containers. Spreaders are suspended from cranes via a head block or cables, which can be used to lower the spreader onto the roof of a container for engagement of the locking mechanisms. Typically, "twist locks" on the spreader engage four upper corner fittings of the shipping container, locking the spreader to the container so that it can be safely lifted. While such spreaders are ubiquitous in the shipping industry, they are predominantly configured for standard cargo containers and therefore cannot collapse the new type of collapsible cargo container developed by the present inventors. Accordingly, as these new collapsible cargo containers work their way into the shipping industry the need for specialized spreaders will also be needed.

SUMMARY OF THE INVENTION

The present invention is a variation of a cargo container lifting device known as "spreader" which is used to lift cargo shipping containers used for transporting goods via ship, rail and truck, and method for using same. The spreader described herein differs from all other spreaders in that it is designed to assist in the folding of a unique collapsible container described in a related provisional patent application. The purpose of such a spreader is to help automate the collapsing and unfolding procedure, as well as to simplify the design of the container, thus reducing its cost by integrating motors, actuators, levers, etc. into the spreader instead of into each container.

Other features and advantages of the invention will become apparent from the following detailed description, taken in conjunction with the accompanying drawings which illustrate, by way of example, a new spreader for collapsible cargo containers and method for using same.

BRIEF DESCRIPTION OF THE DRAWINGS

In the attached drawings, the roof and several other parts of the container are sectioned, and the near-side walls of the container have been removed for clarity. The container is viewed looking up from below ground level to reveal relevant details inside the container, but would in actually be resting on a supporting platform such as the ground, another container, a truck chassis, etc. during the container folding/unfolding procedure.

DETAILED DESCRIPTION OF THE PREFERRED EMBODIMENTS

Figure 1:
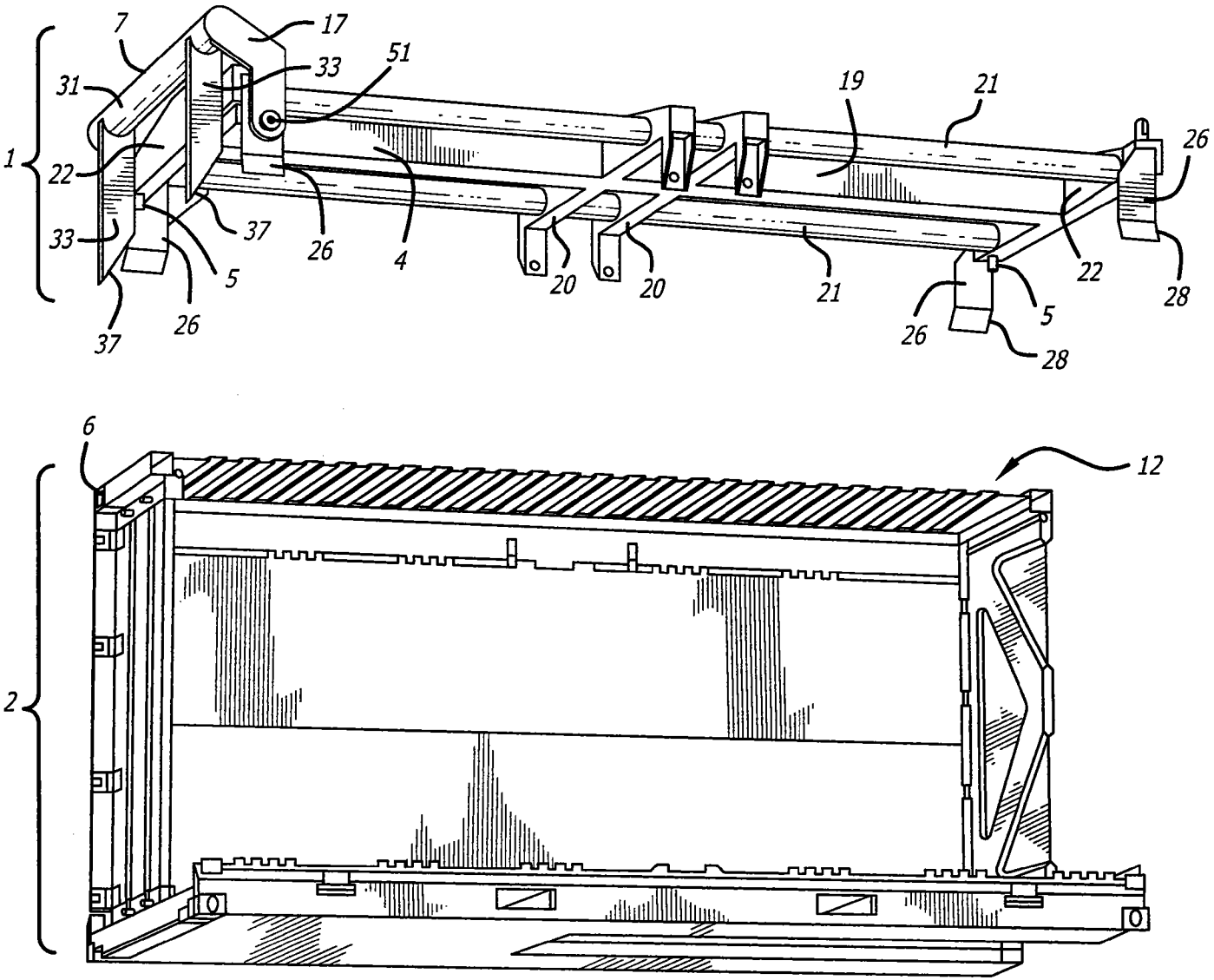
FIG. 1 illustrates a perspective view of the spreader of the present invention positioned above a cargo container.

FIG. 1 shows a first preferred embodiment of a spreader 1 positioned above a new collapsible container 2. Shown below the spreader in FIG. 1 is a collapsible container (shown with a front half omitted to illustrate the interior structure) such as that set forth in U.S. patent application Ser. No. 11/792,161, the contents of which is fully incorporated herein by reference. In operation the spreader 1 would be lifted by a modified standard fork lift using a head block or a plurality of lifting cables. The spreader 1 may have multiple lifting eyes (not shown) positioned at the corners to resist rotation of the suspended container 2, or may have attachment points for other guidance devices or cables. A forklift can also be used to carry the spreader, suspended by short mechanical links instead of cables. Simplified representations of industry-standard twist locks 5 are shown.

The frame 4 is formed from a steel I-beam 19 having cross beams 20 and longitudinal reinforcing members 21. The rigid steel beams and members that cooperate to form the frame 4 should be constructed of a high strength steel having low corrosion properties to operating in coastal climates. The I-beam 19 includes transverse end members 22, which cooperate with the longitudinal reinforcing members 21 to form a rigid structure. Mounted to the transverse end members 22 at each outer surface is a vertical guide flipper 26 that encloses the top of the collapsible container 2 and assists in maintaining a vertical reduction of the container without unwanted tilt or lean. Each vertical guide flipper 26 includes a flared tip gather guide-portion 28 that funnels or guides the outer edge of the container's upper surface into position against the spreader's frame 4.

On each side of the frame 4 at the transverse end members 22 is a pusher assembly 7 (shown only on left side for simplicity in drawings) having left and right arms 17 pivotally mounted to the frame 4. The pusher assembly 7 is preferably driven by a hydraulic engine mounted on the spreader 1 (not shown), although other forms of motors or power systems are considered within the skill of the art. A pusher bar 31 mounted between the two arms 17 includes a pair of rigid vertical struts 33 having angled lower edges for engaging the cargo container's door and end walls in a flush manner. As explained below, as the hydraulic engine drives the pusher assembly about the pivot pin 51, the rotation of the arms 17 and the pusher bar 31 cause the ends 37 of the vertical struts 33 to engage and rotate the end wall and doors of the collapsible cargo container.

Figure 2:
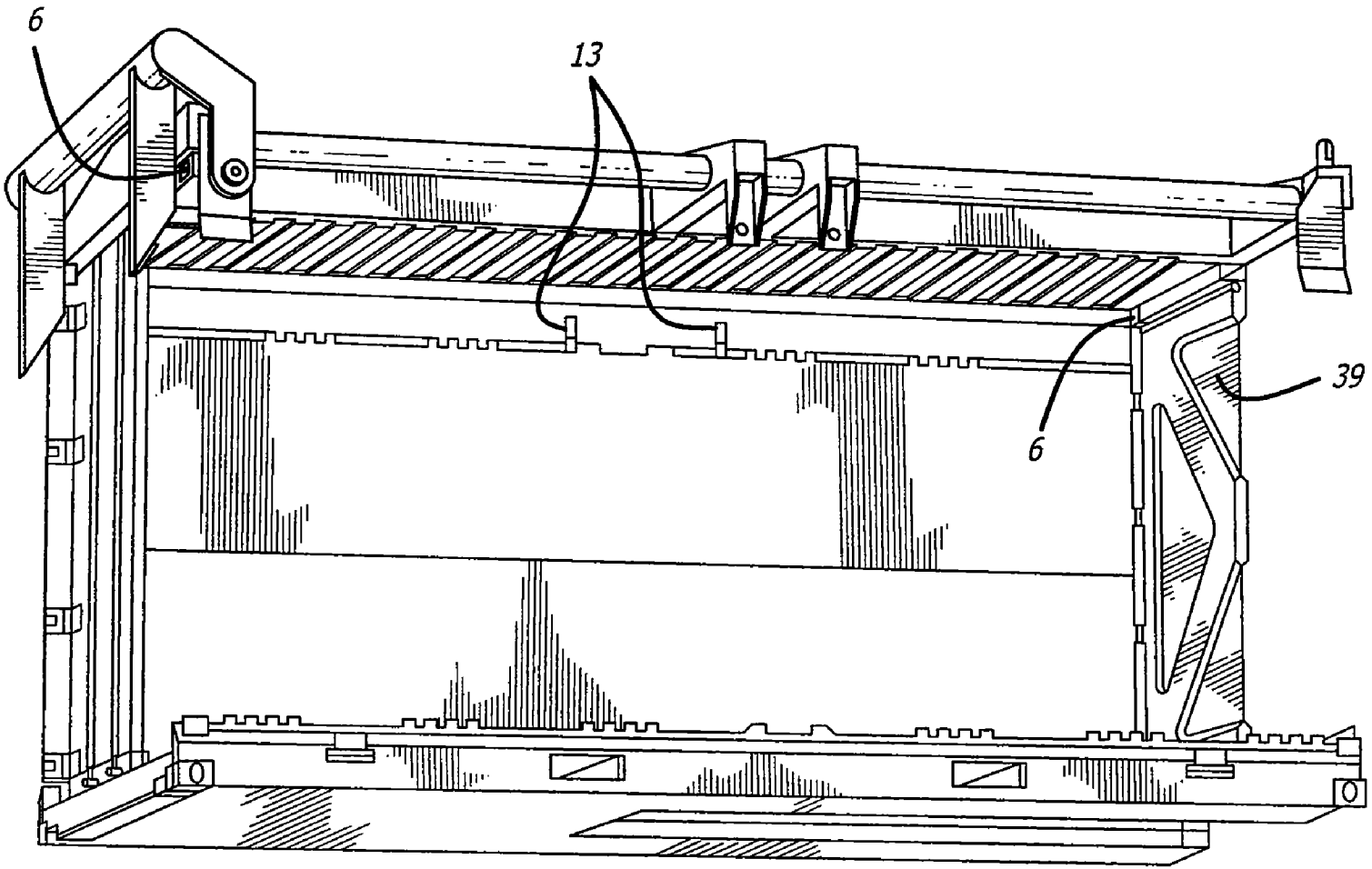
FIG. 2 illustrates a perspective view of the spreader of the present invention engaged with a top of a cargo container.

FIG. 2 shows the spreader 1 resting on the upper wall or ceiling 12 of the container 2, with the twist locks 5 engaged at the corner fittings 6. The two pusher assemblies 7 at respective ends of the spreader 1 pivot about pins 51 mounted to the spreader's frame 4. For simplicity's sake, only the left pusher assembly 7 is shown in the figures, although there would be a corresponding assembly on the right hand side of the spreader 1 that operates in a similar manner for rotating the opposing end wall 39.

Figure 3:
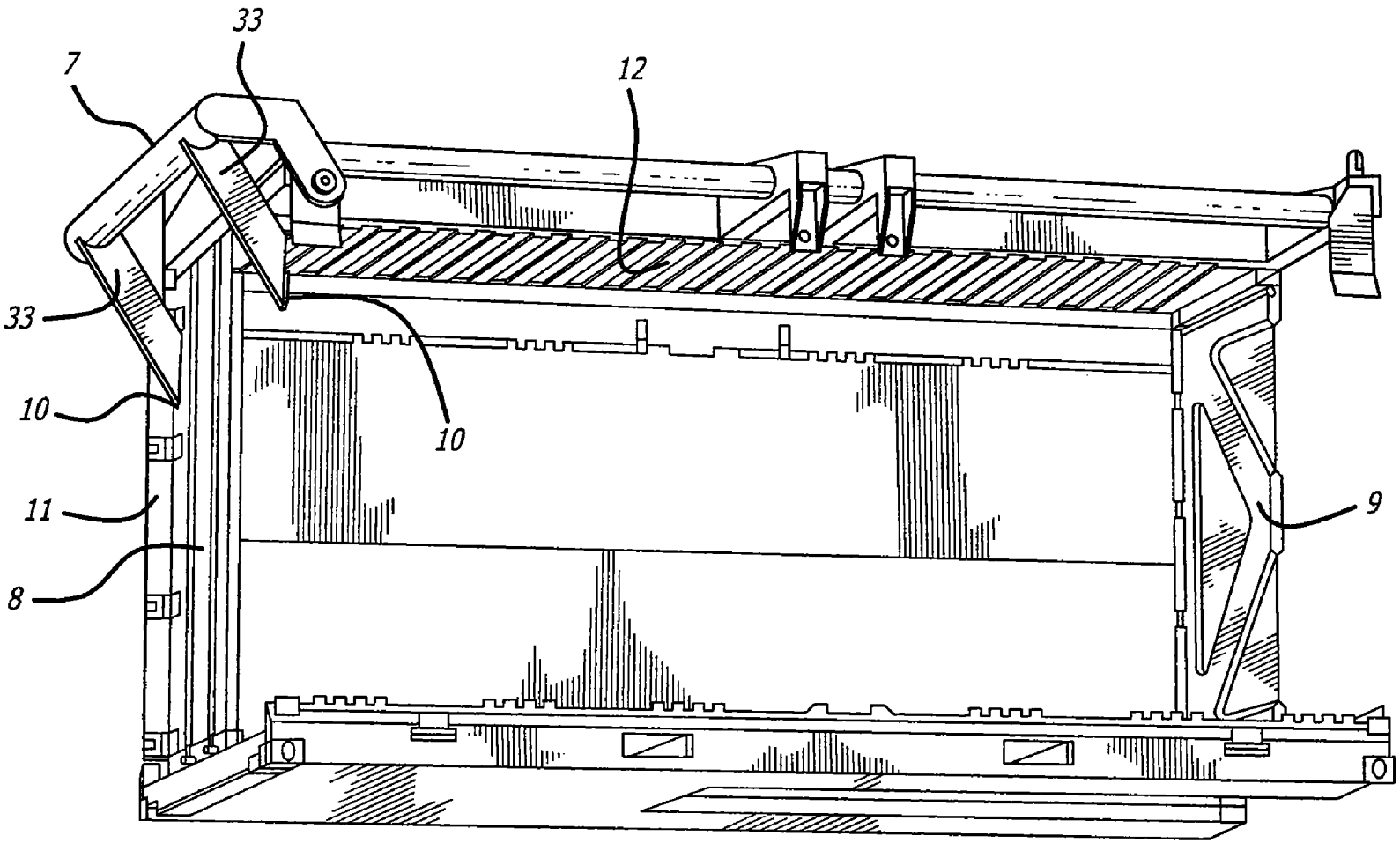
FIG. 3 illustrates a perspective view of the spreader of the present invention with pivoting arm positioned against cargo container door.

FIG. 3 shows the struts 33 of the pusher assembly 7 after it has rotated into contact with the doors 8 of the container 2. Contact is made via pads 10 on the struts 33, where the pads 10 may make contact with either the door 8 or the adjacent door aperture frame 11 that supports the doors 8, and to which the doors are attached on their outermost edges via hinges. A releasable locking mechanism (not shown) may be employed to secure the struts 33 either to the doors 8 or to the door aperture frame 11, or to both at pads 10. An actuator on the spreader 1 releases a mechanism within the door aperture frame 11 that keeps it locked in the upright position as shown.

Figure 4:
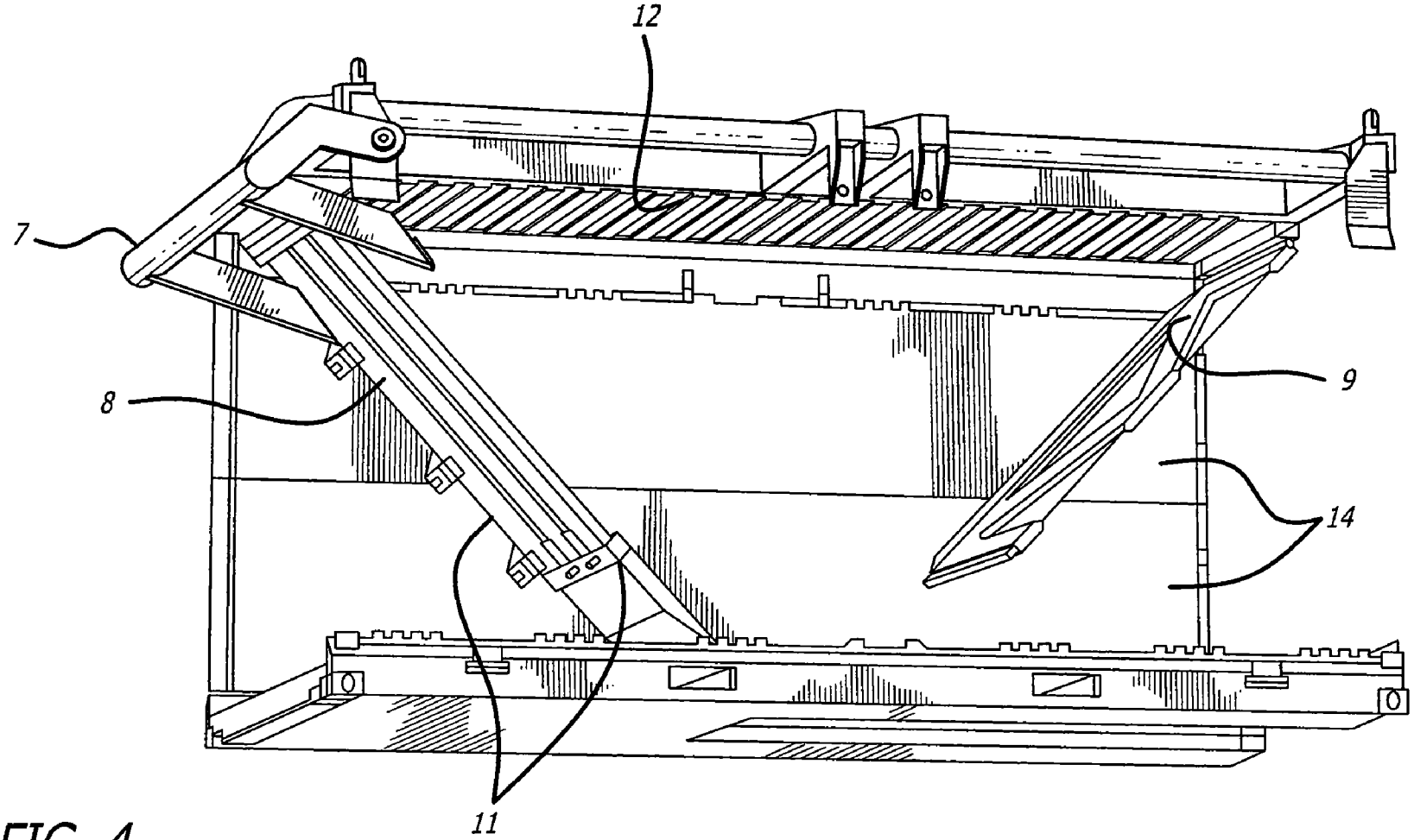
FIG. 4 illustrates a perspective view of the spreader of the present invention with cargo doors rotated upwards as part of collapsing sequence.

With the door aperture frame unlocked, FIG. 4 shows the spreader collapsing the container at the door aperture frame 11 and doors 8 as they are transitioned from their vertical orientation to a position pushed up into the roof 12 by the rotation of the pusher assembly 7, after release of the retention mechanism. Note that only the left hand side of the door and frame, and end wall, are shown to better illustrate the interaction of the spreader 1 with the container 2. A similar pusher assembly 7 on the opposite end of the spreader 1 would serve to act on the end wall 9 of the container 2 in the same manner.

Figure 5:
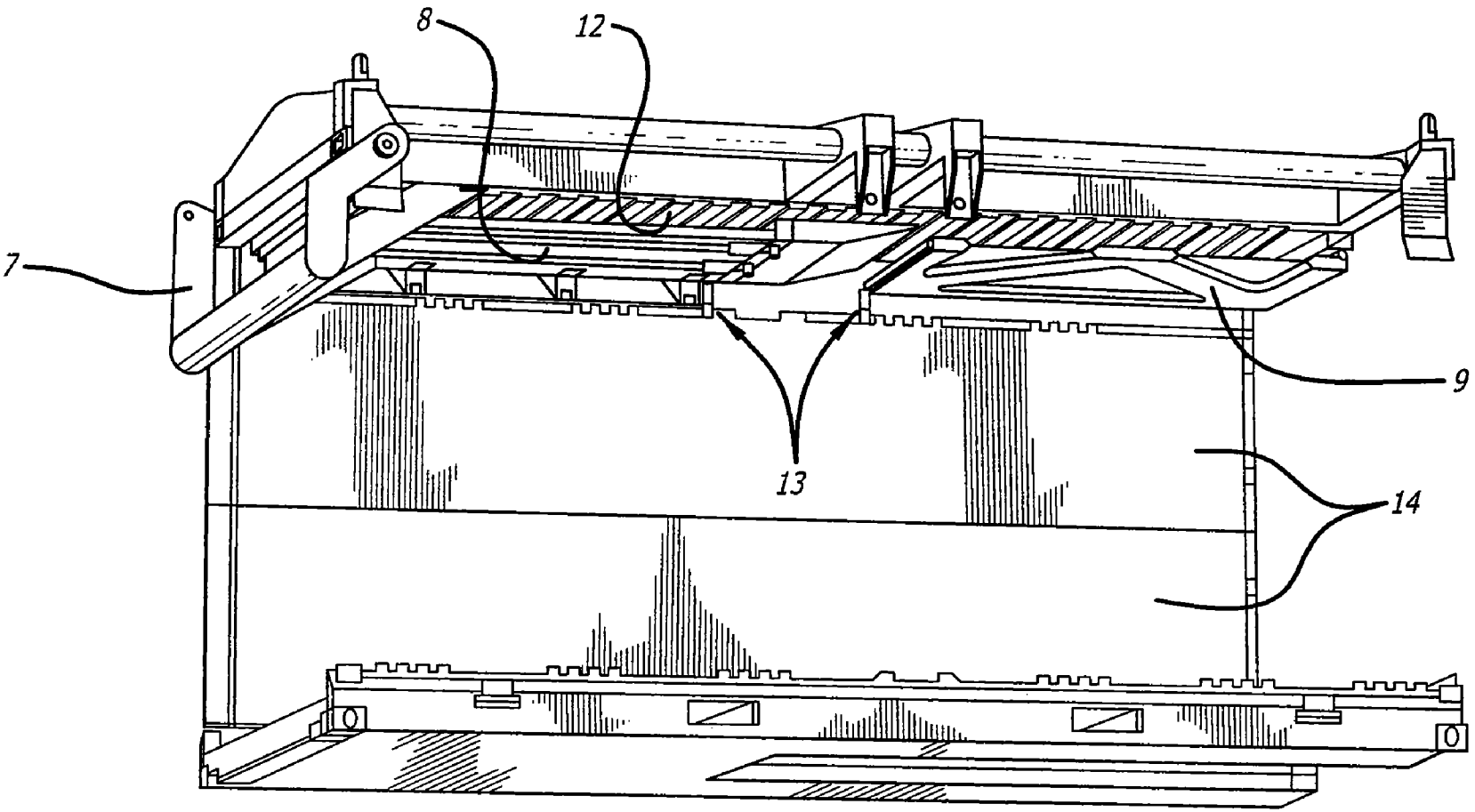
FIG. 5 illustrates a perspective view of the spreader of the present invention with cargo doors rotated against cargo container ceiling as part of collapsing sequence.
Figure 6:
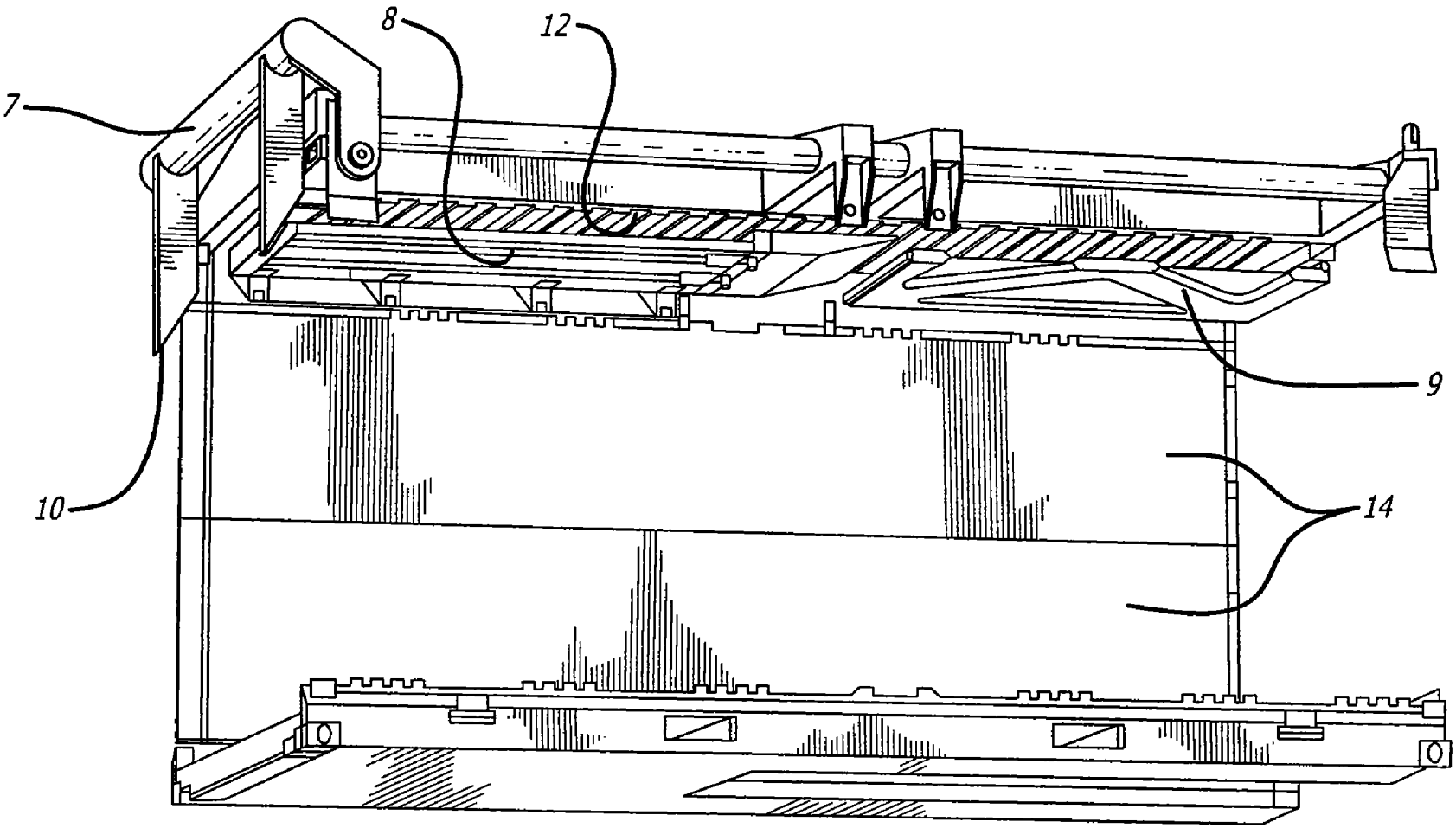
FIG. 6 illustrates a perspective view of the spreader of the present invention with the pivoting arms rotated back to a neutral position.

FIG. 5 shows the doors 8 and end wall 9 pushed fully against the roof 12 of the container 2 by extended rotation of the pusher assembly 7. Up locks 13 on the ceiling of the cargo container hold the doors 8 and front wall 9 in the stowed position. With the end wall 9 and the doors/door frame cleared, the spreader initiates the folding of the side walls 14 of the container 2 from their vertical position to their horizontal position. Once the door 8 and end walls 9 are secure, as shown in FIG. 6, the pusher assembly 7 retracts out of the cargo container's interior after the pads 10 have disengaged from doors 8 or frame 11.

Figure 7:
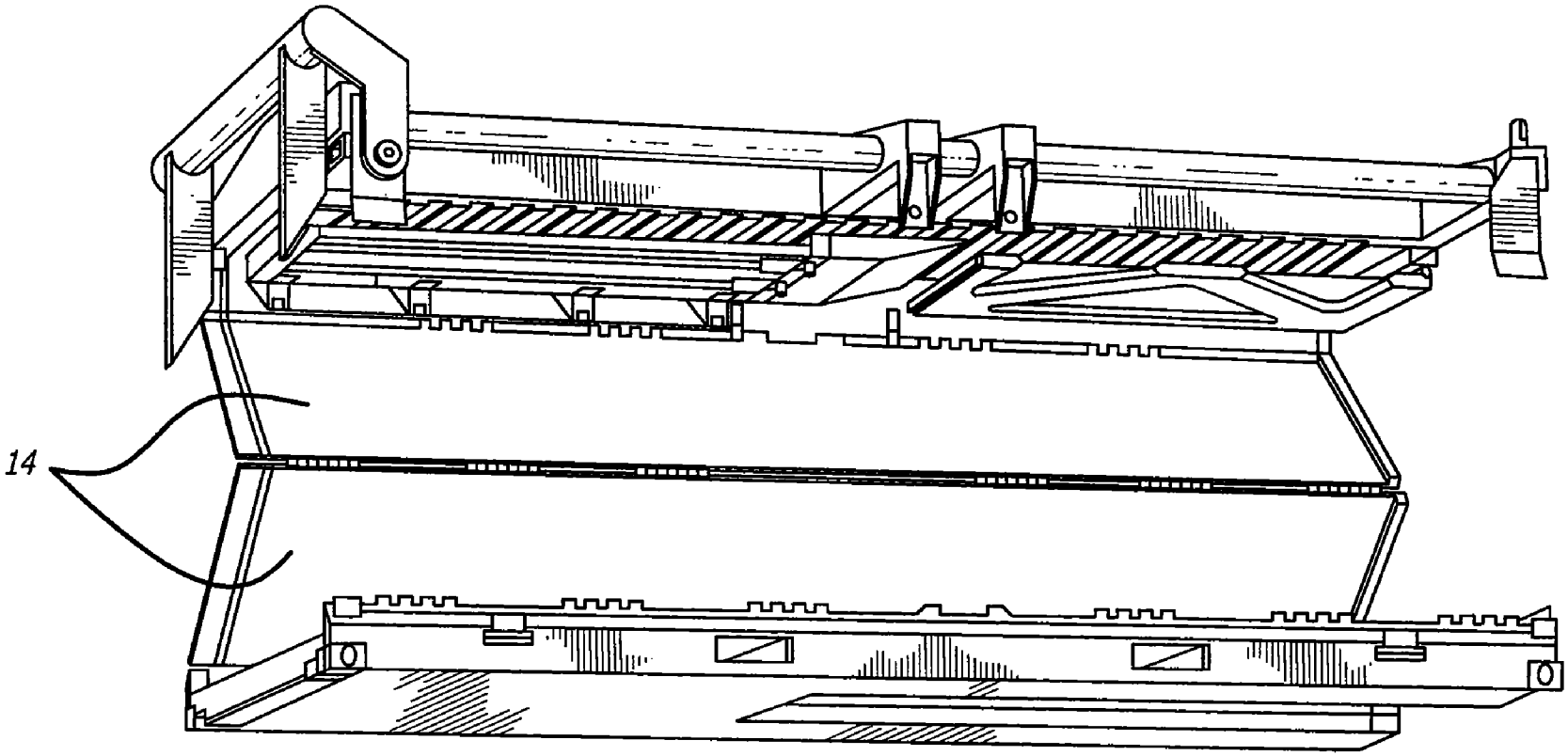
FIG. 7 illustrates a perspective view of the spreader of the present invention with the side walls of the cargo container collapsing as part of collapsing sequence.
Figure 8:
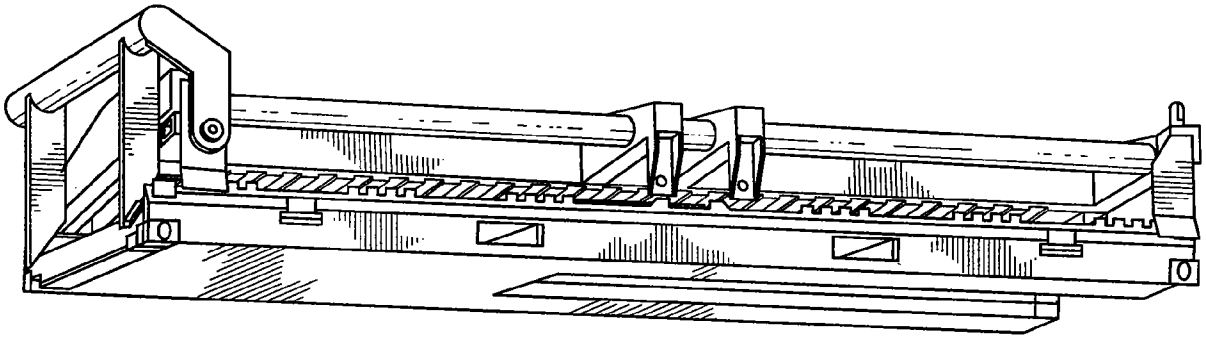
FIG. 8 illustrates a perspective view of the spreader of the present invention above a fully collapsed cargo container ceiling.

FIG. 7 shows the spreader 1 lowering toward the ground as the container side walls 14 beginning to fold into two separate halves. The cargo container may incorporate a release such that once the doors and end wall are mounted to the ceiling in the stowed away position, the side walls 14 may be allowed to collapse. Alternatively, the spreader may include separate pusher assemblies like those described previously that initiated the folding operation by acting on the side walls 14 to apply an inwardly directed force. This force helps to buckle the two halves of the side walls 14 and begin the collapsing of the walls from their initial vertical state. Once the side walls begin to fold, the spreader 1 can complete the collapsing process as the ceiling weighted with the additional mass of the door and end wall force the side walls into their respective horizontal positions. FIG. 8 shows the spreader above the fully collapsed container.

Figure 9:
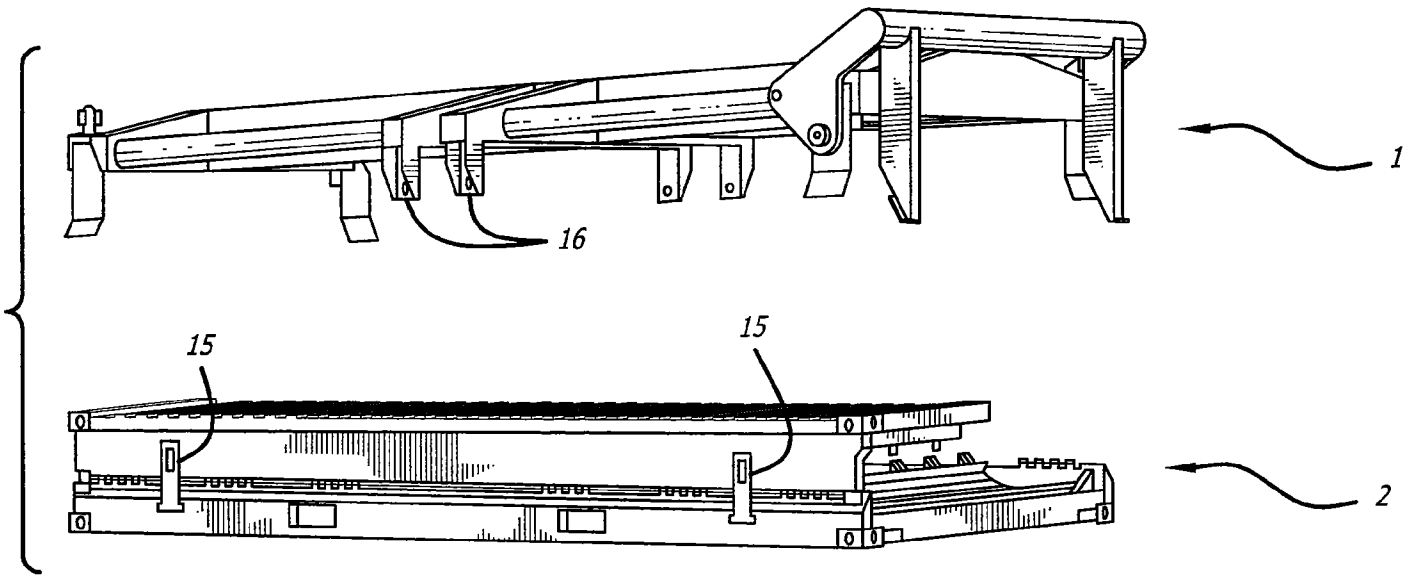
FIG. 9 illustrates a perspective view of the spreader of the present invention positioned over a collapsed cargo container.
Figure 10:
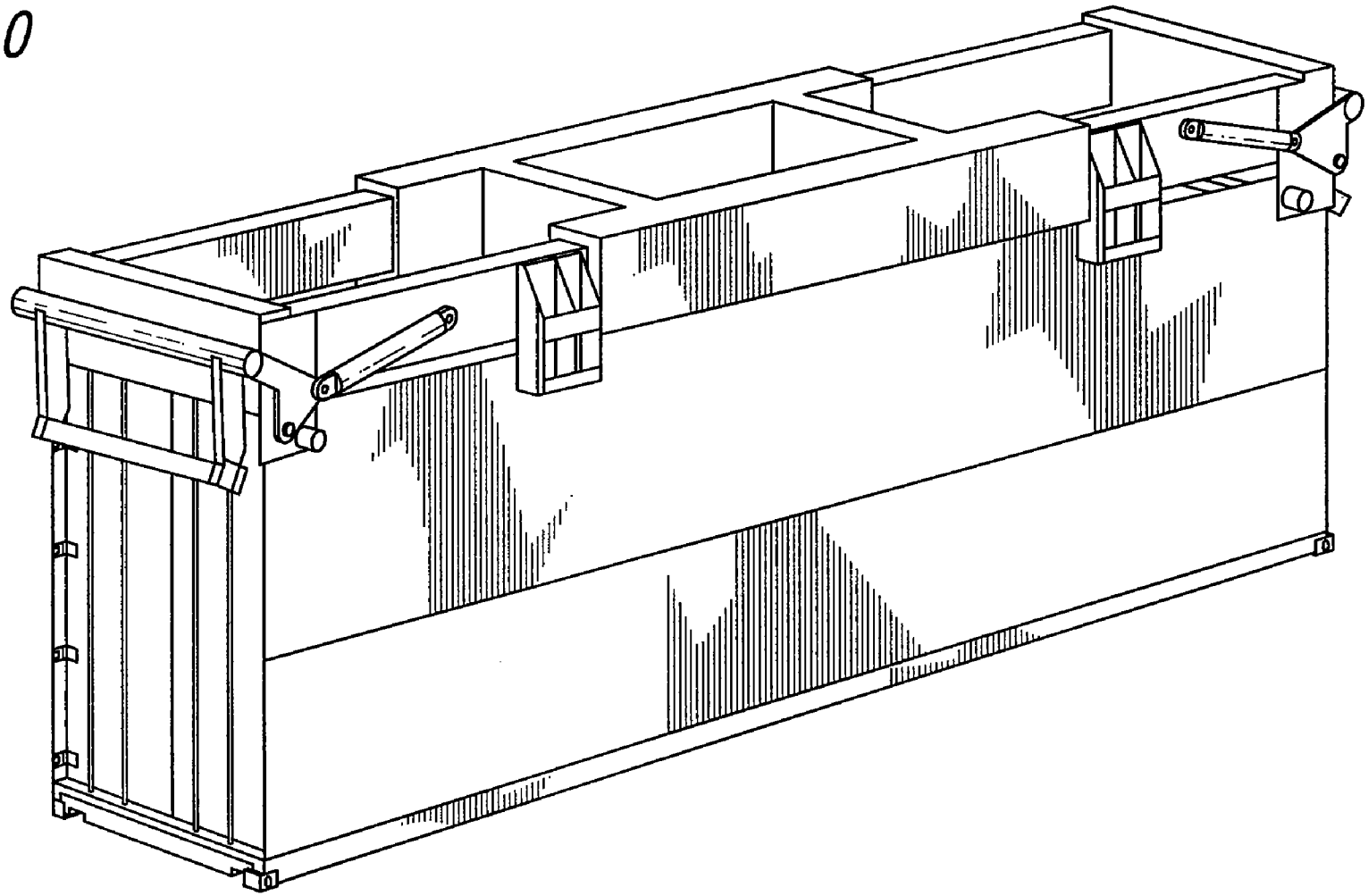
FIG. 10 illustrates a perspective view of a second preferred embodiment of a spreader of the present invention positioned on top of a cargo container.
Figure 11:
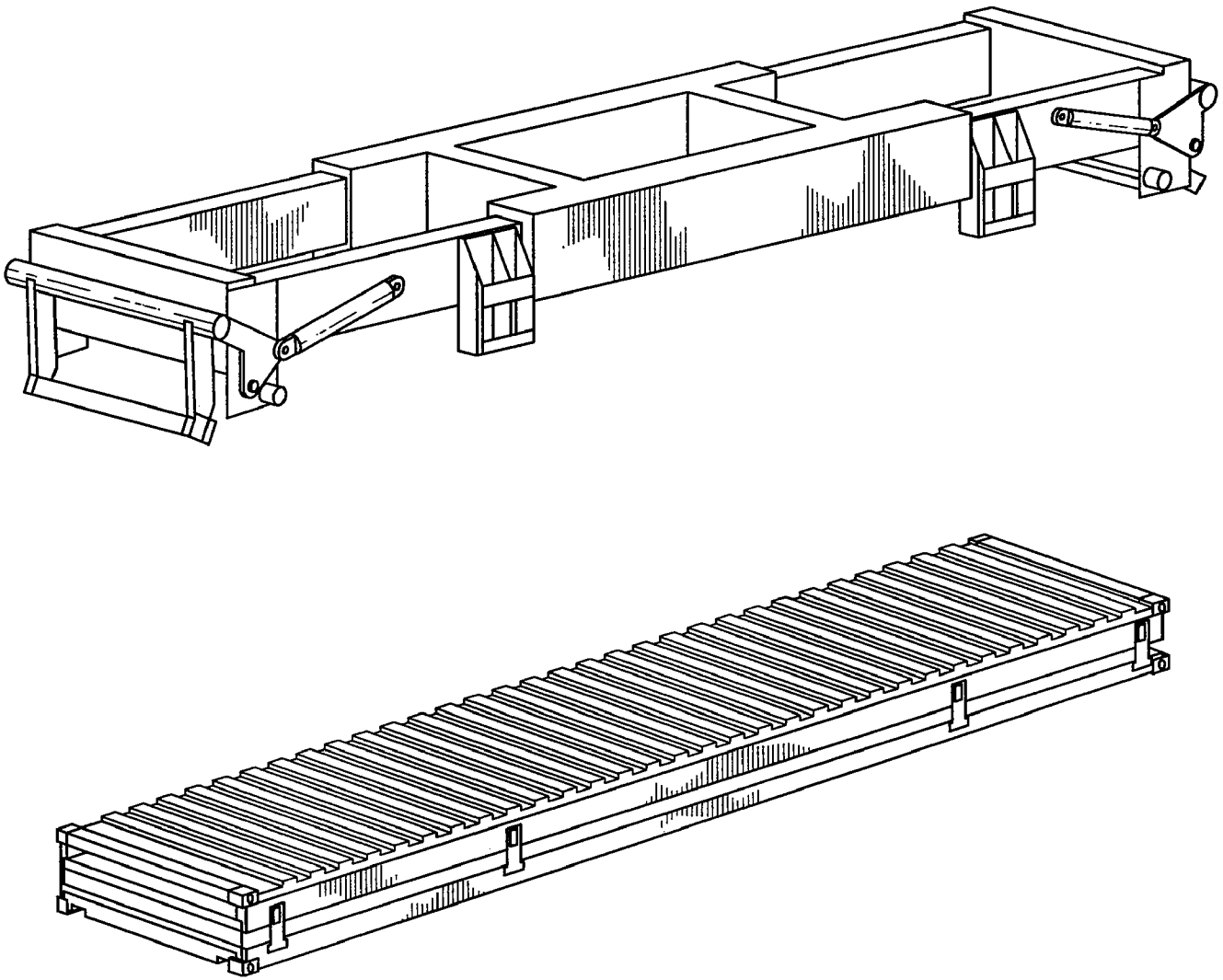
FIG. 11 illustrates a perspective view of the spreader of FIG. 10 positioned over a collapsed cargo container.

FIG. 9 shows the container 2 and spreader 1 as viewed from the other side, after the spreader 1 has unlocked from the container and has been lifted away. From this view, closure clamps 15 can be seen, which keep the container 2 in the collapsed state should it be lifted from above. The closure clamps 15 can be released by extensions of the spreader 1 to automate unfolding process. Unfolding the container is essentially the reverse of the previously described procedure, except that closure clamps 15 and up locks 13 need to be released as necessary by actuators mounted to the sides of the spreader via brackets 16.

The possible employment of a secure connection between arm 7 to the doors 8 and/or to the door aperture frame 11 as described for FIG. 3 is primarily intended to allow the arm 7 to securely pull the doors and/or to the door aperture frame into the locked upright position during the last few inches of travel in the unfolding operation.

Also, the spreader may preferably include a self-contained hydraulic system to operate the various mechanisms, so that the only connection which has to be made (besides mechanical) when engaging the new spreader is electrical. An electrical cable (not shown) with a multi-pin electrical connector on the new spreader would connect to the existing spreader, which would need to have an electrical junction box added to receive the connector. The cable provides electrical power to operate the hydraulics on the new spreader, and also relays control signals between the new spreader and the operator in the crane or other lifting equipment who would have an auxiliary control panel. The new spreader is designed to expand and contract to fold containers of 20-foot, 40-foot and 45-foot standard lengths, as well container sizes both greater and smaller.

We claim:

1. A method for collapsing a shipping cargo container comprising the steps of:

providing a modified spreader above the cargo container;

coupling the spreader to the cargo container using a releasable locking mechanism;

actuating a pusher assembly at a first end of said spreader to engage a door of the cargo container, said pusher assembly rotating to pivot said door from a vertical orientation to a generally horizontal orientation against a ceiling of said cargo container;

actuating a second pusher assembly at a second end of the spreader to engage an end wall of the cargo container, said second pusher assembly rotating to pivot said end wall from a vertical orientation to a generally horizontal orientation against the ceiling of said cargo container; and folding first and second side walls of said cargo container from a vertical orientation to a substantially horizontal orientation, such that said ceiling of said cargo container is spaced from a floor of said cargo container by substantially a width of said folded side walls.

2. The method of claim 1 wherein said spreader includes vertical guides disposed at peripheral positions for aligning said releasable locking mechanism to the cargo container.

3. The method of claim 1 further including the step of engaging the side walls with said spreader to initiate the folding of said first and second side walls.

4. A method of unfolding a collapsed cargo container using a spreader comprising the steps of:

aligning the spreader with an upper portion of the collapsed cargo container;

coupling the spreader to the cargo container using a releasable locking mechanism;

unfolding first and second side walls of said cargo container from a substantially horizontal orientation to a vertical orientation by using said spreader to lift said upper portion of said collapsible cargo container;

actuating a pusher assembly at a first end of said spreader to engage a door of the cargo container, said pusher assembly rotating to pivot said door from a horizontal orientation to a vertical orientation;

actuating a second pusher assembly at a second end of the spreader to engage an end wall of the cargo container, said second pusher assembly rotating to pivot said end wall from a horizontal orientation to a vertical orientation; and disengaging said spreader from said collapsible cargo container.

5. A spreader for lifting and collapsing a cargo container comprising:

a frame assembly to structurally support the lifting of the cargo container, including locking means cooperating with complimentary structure on the cargo container for releasably locking the spreader to an upper portion of the cargo container;

connectors mounted on the frame assembly for mounting to a cargo container;

first and second pus her assemblies disposed at respective first and second ends of the spreader, said first and second pusher assemblies including rotatably mounted arms for engaging pivoting walls of the cargo container and pivoting said walls from a vertical orientation to a horizontal orientation against an inner upper surface of said cargo container.

* * * * *